United States Patent [19]

Spence

[11] 4,182,996

[45] Jan. 8, 1980

[54] MAGNETIC R.F. POWER SPLITTER AND POWER COMBINER

[76] Inventor: Lewis C. Spence, 948 Ave. East, Rivera Beach, Fla. 33404

[21] Appl. No.: 884,936

[22] Filed: Mar. 9, 1978

[51] Int. Cl.[2] ..... H01P 5/12

[52] U.S. Cl. ..... 333/100; 333/127

[58] Field of Search ..... 333/100, 123, 127, 136

[56] References Cited

U.S. PATENT DOCUMENTS

| | | | |
|---|---|---|---|
| 3,091,743 | 5/1963 | Wilkinson | 333/127 |
| 3,103,638 | 9/1963 | Greuet | 333/127 |

*Primary Examiner*—Alfred E. Smith
*Assistant Examiner*—Robert E. Wise
*Attorney, Agent, or Firm*—Snider, Sterne & Saidman

[57] ABSTRACT

A power splitter is disclosed for dividing radio frequency (R.F.) power applied to an input terminal equally among n number output terminals, where n≧2 and is an integer, irrespective of the impedances at the input or at the output terminals. The power splitter utilizes n number λ/4 inner conductors disposed in a λ/4 housing, which provides a common electromagnetic shield. The input terminal is formed by connecting together the first end of each inner conductor, the first ends being present at a first opening in the housing. The second ends of the inner conductors, which are all present at a second opening in the housing, are connected together outside the housing by (n−1) number λ lines so as to form an electrical wheel. Each end at the second opening is an output terminal of the power splitter. A power combiner is disclosed for summing at an output terminal R.F. power applied to n number input terminals, where n≧2 and is an integer, irrespective of the impedances at the input or output terminals. The power combiner utilizes n number λ/4 inner conductors disposed in a λ/housing, which provides a common electromagnetic shield. The first end of each inner conductor present at a first opening in the housing is an input terminal. The output terminal is formed by connecting together the second ends of each inner conductor present at the second opening in the housing.

12 Claims, 10 Drawing Figures

MAGNETIC R.F. POWER SPLITTER AND POWER COMBINER

BACKGROUND OF THE INVENTION

1. Field of the Invention

The present invention relates generally to the field of radio frequency (R.F.) splitters and combiners and, more particularly, to R.F. splitters and combiners which utilize a λ/4 housing to house the λ/4 inner conductors.

2. Description of the Prior Art

The capability of being able to split or combine electrical power at radio frequencies, particularly at very high frequencies (VHF) and ultra high frequencies (UHF), is very important. The capability of power splitting is needed when one source or exciter of R.F. power is being used to drive more than one R.F. amplifier or antennas. An ideal power splitter would have a very broad bandwidth and would provide equal amounts of power from the exciter to each active unit connected to each output terminal of the splitter. In the ideal splitter, the shorting of one of the output terminals (i.e., zero impedance) would cause the power delivered by the exciter to each other output terminal to be reduced by an equal amount, thus preventing overdrive of the remaining active units connected to the unshorted output terminals. Moreover, the opening of one of the output terminals (i.e., infinite impedance) would cause the power delivered by the exciter to each other output terminal to remain the same, thus also preventing overdrive of the active units connected to the output terminals.

The ideal splitter would allow the transfer of power from the exciter to each active unit to be independent of the transfer to other active units regardless of load impedance, which would mean that all power reflected by each active unit back towards the exciter (caused by a standing wave ratio of greater than 1:1) would be absorbed in the splitter and would not be propagated or "dumped" to the other active units. In this condition, a very low loss path would exist between the exciter and each active unit, and a very high loss path would exist between each active unit and the exciter and other active units.

An ideal combiner would have a very broad bandwidth and would sum at an output terminal the R.F. power applied at each input terminal, regardless of the level of power applied to and the impedance at each input terminal. In the ideal power combiner, the shorting of one of the input terminals (i.e., zero impedance) would cause the power at the output terminal to be decreased by an amount equal to the level of power applied to that input terminal before shorting, but would not cause any power to be propagated or "dumped" from one input terminal to another input terminal. Moreover, the opening of one of the input terminals (i.e., infinite impedance) would cause the power at the output terminal to be decreased by an amount equal to the level of power applied to that input terminal before opening, but would not cause any power to be "dumped" from one input terminal to another input terminal. Thus, each active unit connected to an input terminal would electrically "see" the output terminal separately and would be unaffected by the operation of the active units connected to the other input terminals.

Presently-known power splitters and combiners exhibit performance capabilities far removed from the ones that would be found in the idealized versions given above. With respect to power splitters, the active unit having the lowest input impedance receives a disproportionate amount of power from the exciter, the amount of which is given by ohm's law. This phenomena of unequal drive power being furnished by the prior art splitters to each active unit results in power "hogging" by the active units having the lowest impedances, which produces several disadvantages.

Because of the different load impedances of the active units, the exciter has problems achieving optimum tuning with respect to the various active units as electrically "seen" through the power splitter. Moreover, in order to provide optimum drive power to the active units having higher impedance loads, the exciter drive power must be increased. However, this increase in exciter drive power often results in an overdrive condition with respect to the lower impedance loads, which at best causes distortion in the output signals and at the worst causes electrical failure to the active units having the lower impedance loads.

Electrical failure to the lower impedance loads is particularly prevalent with amplifiers using solid state devices, as opposed to tubes, as the active elements because solid state devices are currently more susceptible to electrical failure from overdrive when operation is at VHF or UHF. In order to prevent overdrive electrical failure using presently-known power splitters, it has often been necessary to drive all of the active units at a level below that of optimum efficiency in order to be certain to prevent any electrical failures. An alternate approach using prior art power splitters has been to add additional impedance elements to the input stages of each of the active units so as to make the effective input impedance of each active unit equal. However, these impedance elements often must have very low ohmic values and often must have high dissipation and tolerance ratings which cause considerable increased cost. Moreover, considerable time must be spent selecting the correct input impedance value for each active unit, and this process usually must be repeated each time the active device of the active unit is replaced.

An additional problem present in prior art power splitters is caused by the power reflected back to the exciter and the other active units by an active unit that is not optimally matched to the exciter by the splitter. This reflected power causes drive power to be spilled over or "dumped" through the splitter from each active unit to the other active units. When one of the active units becomes an open circuit (infinite impedance), overdrive can suddenly become present with the remaining active units because of the reflected power from the open output terminal. This can cause a type of destructive electrical domino effect which does not stop until the active elements in each of the active units has failed.

Presently-known hybrid and N-way combiners exhibit several major deficiencies. When the output power produced by several active units is summed using present-day combiners, power is "dumped" by each active unit to the others unless each exhibits the same output impedance and power level. This power "dumping" often results in electrical failure to the output active devices in the active units. It should be noted that prior art combiners in such applications often consist of separate $\frac{1}{4}$ λ (at the frequency of operation) coaxial lines connected between each active unit and the common output terminal. Each ¼ λ line has a separate outer braid or sheath. An alternative approach is to use a power combining "tree", which changes the impedance in steps between the input terminals and the output terminals. Such "trees" require a considerable number of stages, which reduces bandwidth and greatly increases attenuation in the forward direction and must be tailor-made for each set of input and output impedances and power levels.

SUMMARY OF THE INVENTION

It is an object of the present invention to provide a power splitter for dividing R.F. power applied to an input terminal equally among n output terminals, where $n \geqq 2$ and is an integer.

It is another object of the present invention to provide a power splitter having negligible attenuation in the forward direction, i.e., from the input terminal to the output terminals.

It is a further object of the present invention to provide a power splitter having substantial attenuation in the reverse direction.

It is another object of the present invention to provide a power splitter having negligible power "dumping," irrespective of the impedance at the input terminal and at each output terminal.

It is a further object of the present invention to provide a power splitter having a wide bandwidth in the forward direction, while still exhibiting substantial attenuation in the reverse direction.

It is an additional object of the present invention to provide a power combiner for summing at an output terminal R.F. power applied to n input terminals, where $n \geqq 2$ and is an integer.

It is a further object of the present invention to provide a power combiner having negligible attenuation in the forward direction, i.e., from the input terminals to the output terminal.

It is another object of the present invention to provide a power combiner having substantial attenuation in the reverse direction.

It is a further object of the present invention to provide a power combiner having negligible power "dumping" between input terminals.

Finally, it is another object of the present invention to provide a power combiner having a wide bandwidth in the forward direction, while still exhibiting substantial attenuation in the reverse direction.

The power splitter of the present invention causes R.F. power applied by a source to an input terminal to be divided equally among n number output terminals, where $n \geqq 2$ and is an integer. The power splitter includes n number of separate λ/4 inner conductors disposed in a λ/4 housing which provides an electromagnetic shield between the conductors and the outside electrical environment. The inner conductors are electrically insulated from each other and the housing, and are mounted in the housing so that the first end of each inner conductor is adjacent a first opening in the housing and the second end of each inner conductor is adjacent a second opening in the housing. The first ends are all connected together, forming the input terminal. There are also $(n-1)$ separate λ lines, each having a center conductor and a shield conductor. The center conductor of each λ line connects together outside said housing a pair of said second ends of said inner conductors so that an electrical wheel is formed. Each second end is an output terminal of the splitter.

The power combiner of the present invention causes R.F. power applied by sources to n number input terminals—where $n \geqq 2$ and is an integer—to be summed at an output terminal. The power combiner includes n number of separate λ/4 inner conductors disposed in a λ/4 housing which provides an electromagnetic shield between the conductors and the outside electrical environment. The inner conductors are electrically insulated from each other and the housing, and are mounted in the housing so that the first end of each inner conductor is adjacent a first opening in the housing and the second end of each inner conductor is adjacent a second opening in the housing. Each first end is an input terminal. The second ends are all connected together, forming the output terminal of the combiner.

DETAILED DESCRIPTION OF THE PREFERRED EMBODIMENT

Figure 1:
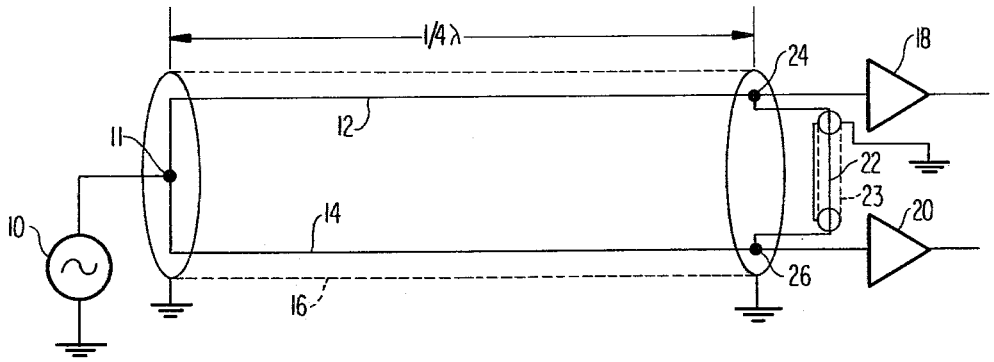
FIG. 1 is a schematic of the power splitter of the present invention for one input terminal and for two output terminals.

Referring to FIG. 1, a power splitter for two active units is shown. R.F. power from a source 10 is applied at an input terminal 11 to one end of an inner conductor 12 and to one end of an inner conductor 14, both inner conductors 12 and 14 being electrically connected together at input terminal 11, the point at which R.F. power from source 10 is applied.

Inner conductors 12 and 14 are each disposed in a housing 16. Housing 16 must provide a shield against electromagnetic energy between inner conductors 12 and 14 and the outside electrical environment. Housing 16 cannot produce an electromagnetic shield between inner conductor 12 and inner conductor 14.

Housing 16 can be any uniform hollow shape, as long as the shape provides the requisite electromagnetic shield. Because housing 16 must provide the requisite electromagnetic shield, it must be electrically conductive. Any appropriate electrically conductive material, either rigid or flexible, can be used to fabricate housing 16. When housing 16 is rigid, it can be entirely electrically conductive or can be a laminate having one or more electrically conductive layers. It is preferable, when housing 16 is a laminate, that the layer on the inside of housing 16 most adjacent inner conductors 12 and 14 be electrically conductive. When housing 16 is flexible, it can be fabricated out of any flexible material that is electrically conductive or has an electrically conductive layer. One example of a flexible version of housing 16 is that of an electrically conductive braid. The physical gaps in the weave of such a braid are a limiting factor in the present invention only with respect to the center frequency of the power splitter; the higher the center frequency, the smaller the gaps should be.

Inner conductor 12 and inner conductor 14 must each be a physical length equal to a quarter electrical wavelength (hereinafter, $\lambda/4$) line at the center frequency of the power splitter. The physical length corresponding to a $\lambda/4$ line is given by:

$$\text{Length (feet)} = (246/f)V \quad (1)$$

where:

f = Frequency in megahertz (mHz);

v = Velocity factor.

Velocity factor V is defined as the ratio of the actual velocity along the line to the velocity in free space. Useful lists giving the electrical characteristics of commonly-available R.F. cables are found in *Reference Data For Radio Engineers*, Howard W. Sams & Co., Inc., Indianapolis, Id., 1975, pages 24–32 to 24–40; *The ARRL Antenna Book*, American Radio Relay League, Newington, Conn., 1974, page 91.

Housing 16 also must be a physical length equal to a $\lambda/4$ line at the center frequency of the power splitter. Housing 16 has a first opening at one end and a second opening at the other end. Equation (1) above can be used to mathematically calculate the physical length for housing 16.

Inner conductors 12 and 14 must be electrically insulated from each other and from housing 16. Inner conductors 12 and 14 can be electrically uninsulated and can be mounted in housing 16 using a support or supports of any configuration that provide the requisite electrical insulation. A gas atmosphere, such as nitrogen, or a dielectric solution, such as transformer oil, can be used in housing 16 to provide additional electrical insulation. Inner conductors 12 and 14 can be mounted in housing 16 using a dielectric potting compound which, after curing, provides electrical insulation as well as physical mounting. Each inner conductor 12 and 14 can originally be provided with an insulation cover or jacket which provides the electrical insulation and physical mounting when the inner conductors 12 and 14 are disposed in housing 16. It is apparent that there are a multitude of possible arrangements for providing the electrical insulation and physical mounting to inner conductors 12 and 14 when they are disposed in housing 16. The only electrical limitation is that the electrical insulation used must have a breakdown voltage parameter sufficient to withstand, without electrical destruction, the electrical power being provided by source 10 to the splitter. The breakdown voltage parameter for commonly-available R.F. cables are given in the two references shown above.

Inner conductors 12 and 14 can be disposed in housing 16 in any arrangement as long as there is one end of each inner conductor 12 and 14 present at each of the two openings of housing 16. Example arrangements of inner conductors 12 and 14 are to have them run straight through, to have them twisted with respect to each other, or to have them closer to each other or to the inner surface of housing 16 at one end of housing 16.

Figure 2A:
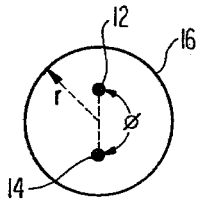
FIG. 2A is a cross-section of the preferred embodiment of the power splitter of the present invention for one input terminal and for two output terminals where the housing is a tube.

When housing 16 is in the shape of a tube having a constant radius r throughout, there is a preferred embodiment for the placement of inner conductors 12 and 14 in housing 16. A cross-section of this preferred embodiment is shown in FIG. 2A, and the cross-sectional dimensions are given by the following equation for the placement of inner conductor 12:

$$\rho,\phi = 0.33\ r,\ 90^\circ \quad (2)$$

where:

$\rho$ = Unit length vector in cylindrical coordinates;

$\phi$ = Angle vector in cylindrical coordinates.

The preferred placement of inner conductor 14 is given by the following equation, expressed in cylindrical coordinates:

$$\rho,\phi = 0.33\ r,\ 270^\circ \quad (3)$$

As is apparent from Equations (2) and (3), inner conductors 12 and 14 are equally spaced from each other and from the most adjacent portion of the inner surface of tube 16.

The end of inner conductor 12 not connected to source 10 is the first output of the splitter and is designated as output terminal 24. The end of inner conductor 14 not connected to source 10 is the second output of the splitter and is designated as output terminal 26. Connected between terminal 24 and terminal 26 is a one electrical wavelength (hereinafter, $\lambda$) line 22 cut for the center frequency of the power splitter. The physical length for line 22 corresponding to an electrical $\lambda$ is given by:

$$\text{Length (feet)} = (984/f)V \quad (4)$$

where:

f = Frequency in megahertz (mHz);

V = Velocity factor.

Line 22 is provided with an electromagnetic housing 23, preferably in the form of a braid. The electromagnetic shield produced by housing 23 is different from that produced by housing 16, but housing 23 is electrically connected to housing 16 by a common ground.

For purposes of explanation only, terminal 24 is connected to an active unit 18, and terminal 26 is connected to an active unit 20.

Experimental results using a power splitter for two active units have produced results that equal or exceed those produced by directional couplers costing much greater amounts. For example, an experimental power splitter for two active units having the electrical circuit shown in FIG. 1 and the physical configuration of FIG. 2A has exhibited the characteristics shown in Table 1.

TABLE 1

| | |
|---|---|
| Frequency of operation | 144 mHz |
| Power at terminal 24 | ½ of power from source 10 |
| Power at terminal 26 | ½ of power from source 10 |
| Attenuation in dB from source 10 to terminal 24 | negligible |
| Attenuation in dB from source 10 to terminal 26 | negligible |
| Attenuation from terminal 24 to terminal 26 or source 10 | in excess of 30 dB |
| Attenuation from terminal 26 to terminal 24 or source 10 | in excess of 30 dB |
| Power increase at terminal 26 when short or open circuit present at terminal 24 | negligible |
| Power increase at terminal 24 when short or open circuit present at terminal 26 | negligible |
| Attenuation from terminal 24 to terminal 26 our source 10; Attenuation from terminal 26 to terminal 24 or source 10, at: | |
| 20% off center frequency | 20 dB |
| octave off center frequency | 12 dB |

The splitter for two active units of the present invention prevents power "hogging" by one active unit, irrespective of the input impedance of any unit connected to the input or to the output terminals. Each active unit appears to be electrically separate to source 10, as seen through the splitter. Thus, power is split evenly between the two active units, irrespective of their input impedances. It is impossible to "dump" anything but an infinitesimal amount of power from one active unit back to source 10 or to the other active unit. Thus, electrical failure of all active units caused by a domino effect of fatal power dumping produced by the electrical failure of one active unit cannot occur in the present invention. It should also be noted that the splitter for two active units of the present invention has a wide effective bandwidth and a very low power loss in the forward direction: approximately 1 dB.

Experimental results have demonstrated that the open-circuiting or the short-circuiting of either terminal 24 or 26 does not result in any appreciable power increase or decrease at the other terminal. Instead, the temperature of the open- or short-circuited terminal increases, suggesting that the power present at this terminal is being dissipated in the magnetic field created by housing 16 around inner conductors 12 and 14.

Figure 2B:
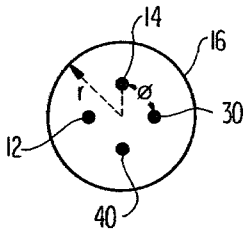
FIG. 2B is a cross-section of the preferred embodiment of the power splitter of the present invention for one input terminal and for three output terminals where the housing is a tube.
Figure 2C:
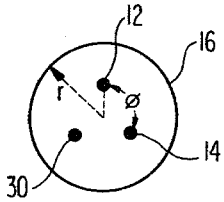
FIG. 2C is a cross-section of the preferred embodiment of the power combiner of the present invention for one input terminal and for four output terminals where the housing is a tube.
Figure 3:
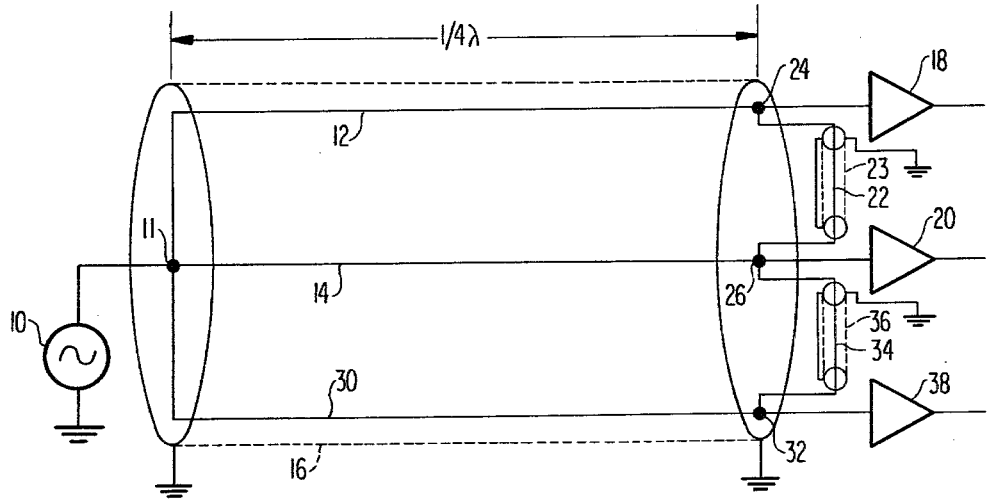
FIG. 3 is a schematic of the power splitter of the present invention for one input terminal and for three output terminals.

Turning now to FIG. 3, the electrical circuit of the power splitter of the present invention for three active units is shown. Like numerals in FIGS. 2 and 3 refer to components common to both power splitters. It should be noted that the discussion above concerning these common components is equally applicable to the power splitter shown in FIG. 3.

An inner conductor 30 is provided in housing 16 to accommodate the third active unit connected to inner conductor 30 at an output terminal 32. Inner conductor 30 is connected to source 10 at input terminal 11 at the end of inner conductor 30 opposite terminal 32, as shown in FIG. 3. The physical length of inner conductor 30, like inner conductors 12 and 14, must be equal to an electrical $\lambda/4$ and can be calculated using Equation (1). Inner conductor 30, like inner conductors 12 and 14, must be within the electromagnetic shield provided by housing 16.

Inner conductors 12, 14 and 30 can be disposed in housing 16 in any arrangement so long as the appropriate ends of inner conductors 12, 14 and 30 are available at the two openings of housing 16.

The cross-section of the preferred embodiment of the power splitter for three active units when housing 16 is a tube having a constant radius r is shown in FIG. 2B. The placement of inner conductor 12 in housing 16, expressed in cylindrical coordinates, is:

$$\rho,\phi=0.366\ r,\ 90^\circ \tag{5}$$

The placement of inner conductor 14 in housing 16, as expressed in cylindrical coordinates, is:

$$\rho,\phi=0.366\ r,\ 225^\circ \tag{6}$$

The placement of inner conductor 30 in housing 16, as expressed in cylindrical coordinates, is:

$$\rho,\phi=0.366\ r,\ 315^\circ \tag{7}$$

Connected between terminal 26 of inner conductor 14 and terminal 32 of inner conductor 30 is a one electrical wavelength (hereinafter, $\lambda$) line 34, cut for the center frequency of the power splitter. The physical length for line 34 is given by Equation (4). Line 34 is provided with an electromagnetic housing 36, preferably in the form of a braid. The electromagnetic shield produced by housing 36 is different from those produced by housings 16 and 23, but housing 36 is electrically connected to housings 16 and 23 by a common ground.

For purposes of explanation only, terminal 24 is connected to active unit 18, terminal 26 is connected to active unit 20, and terminal 32 is connected to active unit 38.

Experimental results using the power splitter of the present invention for three active units show results that far exceed those produced by prior art splitters for three active units. A power splitter for three active units having the electrical circuit shown in FIG. 3 and the physical configuration of FIG. 2B has exhibited the electrical parameters shown in Table 2.

TABLE 2

| | |
|---|---|
| Power at terminal 24 | ⅓ of power from source 10 |
| Power at terminal 26 | ⅓ of power from source 10 |
| Power at terminal 32 | ⅓ of power from source 10 |
| Attenuation in dB from source 10 to terminal 24 | negligible |
| Attenuation in dB from source 10 to terminal 26 | negligible |
| Attenuation in dB from source 10 to terminal 32 | negligible |
| Attenuation in dB from terminal 24 to terminals 26, 32 or source 10 connected to terminal 11 | in excess of 30 dB |
| Attenuation in dB from terminal 26 to terminals 24, 32 or source 10 connected to terminal 11 | in excess of 30 dB |
| Attenuation in dB from terminal 32 to terminals 24, 26 or source 10 | in excess of 30 dB |
| Power increase at terminals 26 or 32 when short or open circuit present at terminal 24 | negligible |
| Power increase at terminals 24 or 32 when short or open circuit present at terminal 26 | negligible |
| Power increase at terminals 24 or 26 when short or open circuit present at terminal 32 | negligible |
| Attenuation from terminal 24 to terminals 26 or 32 source 10; | |

TABLE 2-continued

| | |
|---|---|
| Attenuation from terminal 26 to terminals 24 or 32 or source 10; Attenuation from terminal 32 to terminals 24 or 26 or source 10, at: | |
| 20% off center frequency | 20 dB |
| octave off center frequency | 12 dB |

The splitter for three active units of the present invention prevents power "hogging" by one active unit, irrespective of the input impedances of any of the units connected to the input terminal or to the output terminals. Each of the active units 18, 20 and 38 appears to be electrically separate and distinct to source 10, as seen electrically through the splitter. Power is split evenly into thirds between the three active units, irrespective of their input impedances. It is impossible to "dump" anything but an infinitesimal amount of power from one active unit back to source 10 or to the other active units. Thus, electrical failure of all active units caused by fatal power dumping in domino fashion produced by the electrical failure of one active unit cannot occur in the splitter of the present invention. As shown in Table 2, the splitter of the present invention for three active units has a wide effective bandwidth and a negligible power loss in the forward directions from source 10 to the active units 18, 20 and 38.

Experimental results shown in FIG. 2 demonstrate that the open- or short-circuiting of terminals 24, 26 or 32 does not result in any appreciable power increase or decrease at the other terminals. Instead, the temperature of the open-circuited terminal increases, suggesting that the power present at this terminal is being dissipated in the magnetic field created by housing 16 around inner conductors 12, 14 and 30.

As shown in FIG. 3, λ line 22 is provided between terminals 24 and 26, and λ line 34 is provided between terminals 26 and 32. Because the amplitude and phase of a signal are equal at each λ point along a transmission line (assuming a lossless line), the signal seen at terminal 32 by terminal 24, and vice versa, through the composite 2λ line—line 23 and line 24—is the same as if there was a λ line directly between terminals 24 and 32. This amplitude and phase equality produced at each λ point of a transmission line accounts for the need of only (n−1) λ lines in any embodiment of power splitter of the present invention, where n=number of inner conductors in housing 16. It should be noted that the housing for each λ line must produce a separate electromagnetic shield for that line, and that the λ lines cannot be disposed in a common electromagnetic shield.

The cross-section of the preferred embodiment of the power splitter of the present invention for four active units when housing 16 is a tube is shown in FIG. 2C. The placement of inner conductor 12 in housing 16, as expressed in cylindrical coordinates, is:

$$\rho,\phi=0.414\ r,\ 0^\circ \tag{8}$$

The placement of inner conductor 14, as expressed in cylindrical coordinates, is:

$$\rho,\phi=0.414\ r,90^\circ \tag{9}$$

The placement of inner conductor 30, as expressed in cylindrical coordinates, is:

$$\rho,\phi=0.414\ r,180^\circ \tag{10}$$

The placement of inner conductor 40, as expressed in cylindrical coordinates, is:

$$\rho,\phi=0.414\ r,270^\circ \tag{11}$$

It should be noted that there appears to be no realistic limit to the number of different active units that can be accommodated by the power splitter of the present invention. When there are n number active units to be accommodated, n number λ/4 inner conductors must be provided in housing 16 and (n−1)λ lines must be connected between the terminals of the λ/4 inner conductors opposite the feed point of source 10.

Figure 4:
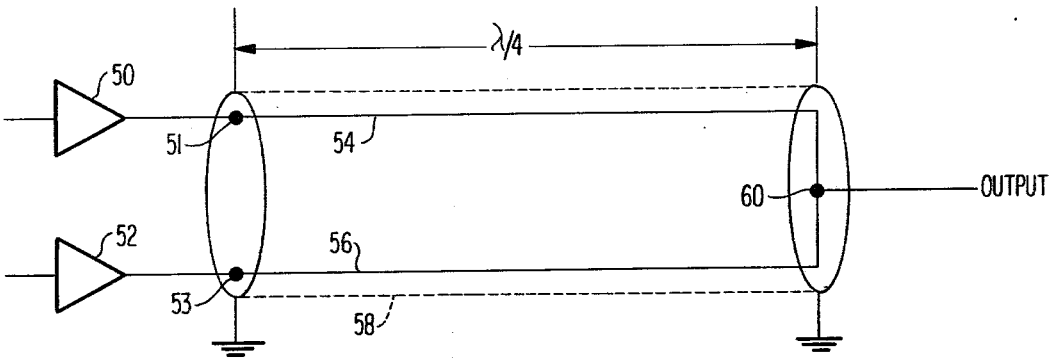
FIG. 4 is a schematic of the power combiner of the present invention for two input terminals and for one output terminal.

Turning now to FIG. 4, a power combiner for two active units is shown. R.F. power from a source 50 is applied at an input terminal 51 to one end of an inner conductor 54 disposed in a housing 58. R.F. power from a source 52 is applied at an input terminal 53 to one end of an inner conductor 56. The other end of inner conductors 54 and 56 are connected together at a terminal 60, which is the output terminal of the power combiner.

Inner conductors 54 and 56 are each disposed in housing 58. Housing 58 must provide a shield against electromagnetic energy between inner conductors 54 and 56 and the outside electrical environment. Housing 58 cannot produce an electromagnetic shield between inner conductors 54 and 56.

Housing 58, like housing 16 of the power splitter described above, can be any shape, as long as the shape provides the requisite electromagnetic shield. The same criteria for housing 16 applies to housing 58.

Inner conductor 54 and inner conductor 56 must each be a physical length equal to a quarter electrical wavelength (hereinafter, λ/4) line at the center frequency f of the power combiner. The physical length corresponding to a λ/4 line is given by Equation (1) above. It should be noted that the frequency of source 50 and the frequency of source 52 can be different from each other and/or from the center frequency f.

Housing 58 also must be a physical length equal to a λ/4 line at the center frequency of the power combiner. Equation (1) above can also be used to mathematically calculate the physical length for housing 58.

Inner conductors 54 and 56 must be electrically insulated from each other and from housing 58 and must be disposed in housing 58 under the same conditions for inner conductors 12 and 14.

Figure 5A:
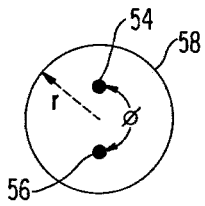
FIG. 5A is a cross-section of the preferred embodiment of the power combiner of the present invention for two input terminals and for one output terminal where the housing is a tube.

When housing 58 is in the shape of a tube having a constant radius r throughout, the cross-section of the preferred embodiment for the placement of inner conductors 54 and 56 in housing 58 is shown in FIG. 5A, and the cross-sectional dimensions are given by the following Equation (2) above for the placement of inner conductor 54. The preferred placement of inner conductor 56 is given by the Equation (3) above. As is apparent from Equations (2) and (3), inner conductors 54 and 56 are equally spaced from each other and from the most adjacent portion of the inner surface of tube 58.

For purposes of explanation only, the input end of inner conductor 54 is connected to an active unit 50 at input terminal 51, and the input end of inner conductor 56 is connected to an active unit 52 at input terminal 53.

Experimental results using a power combiner of the present invention for two active units have exceeded those produced by prior art combiners for two active units. For example, an experimental power combiner for two active units having the electrical circuit shown in FIG. 4 and the physical configuration of FIG. 5A has exhibited the electrical characteristics shown in Table 3.

TABLE 3

| | |
|---|---|
| Frequency of operation | 144 mHz |
| Power output at terminal 60 | equal to the algebraic sum of the power from source 50 and from source 52, irrespective of the impedances of the sources or the impedance connected to terminal 60 |
| Attenuation in dB from source 50 to terminal 60 | negligible |
| Attenuation in dB from source 52 to terminal 60 | negligible |
| Attenuation from source 50 to source 52 | in excess of 30 dB |
| Attenuation from source 52 to source 50 | in excess of 30 dB |
| Attenuation in dB from source 50 to source 52 or from source 50 to source 52, at: | |
| 20% off center frequency | 20 dB |
| octave off center frequency | 12 dB |

The combiner for two active units of the present invention prevents power "dumping" by one active unit to the other active unit, irrespective of the output impedance or output power of each active unit or the impedance at terminal 60. Thus, electrical failure of all active units caused by fatal power dumping in domino fashion by the electrical failure of one active unit cannot occur in the present invention. Power is algebraically summed at terminal 60, irrespective of the output impedance or output power of each active unit or the impedance at terminal 60. It should also be noted that the combiner of the present invention for two active units has a wide effective bandwidth and a very low power loss in the forward direction.

Experimental results have demonstrated that the open- or short-circuiting of either active unit 50 or active unit 52 results only in a reduction in power at terminal 60 equal to the power output from the open- or short-circuited active unit; there is no power dumped by the normal active units to the open- or short-circuited active unit. Moreover, when the load on terminal 60 is open- or short-circuited, only mineral power (attenuation of 18 dB or more) is reflected from terminal 60 to input terminal 51 or input terminal 53. It is suggested that the magnetic field created by housing 58 around inner conductors 54 and 56 is responsible for the summing of power in the combiner of the present invention.

Figure 6:
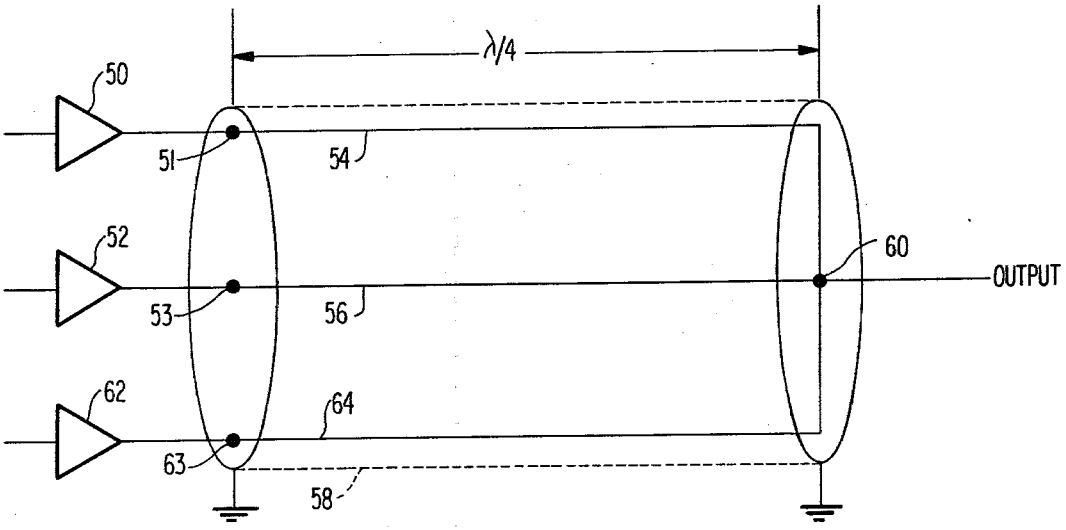
FIG. 6 is a schematic of the power combiner of the present invention for three input terminals and for one output terminal.

Turning now to FIG. 6, the electrical circuit of the power combiner of the present invention for three active units is shown. Like numerals in FIGS. 4 and 6 refer to components common to both power combiners. It should be noted that the discussion above concerning these common components is equally applicable to the power combiner shown in FIG. 6.

An inner conductor 64 is provided in housing 58 to accommodate the third active unit 62 connected to an inner conductor 64 at an input terminal 63. Inner conductor 64 is connected to output terminal 60 at its end opposite the end connected to active unit 62, as shown in FIG. 5. The physical length of inner conductor 64, like inner conductors 54 and 56, must be equal to an electrical $\lambda/4$ and can be calculated using Equation (1). Inner conductor 64, like inner conductors 54 and 56, must be within the electromagnetic shield provided by housing 58.

Inner conductors 54, 56 and 64 can be disposed in housing 58 in any arrangement as long as the appropriate ends of inner conductors are available at the correct openings of housing 58.

Figure 5B:
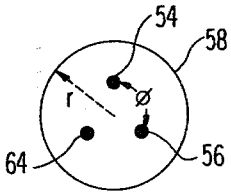
FIG. 5B is a cross-section of the preferred embodiment of the power combiner of the present invention for three input terminals and for one output terminal where the housing is a tube.

The cross-section of the preferred embodiment of the power combiner for three active units when housing 58 is a tube having an inner radius r is shown in FIG. 5B. The placement of inner conductor 54 in housing 58 is given by Equation (5) above, the placement of inner conductor 56 in housing 58 is given by Equation (6), and the placement of inner conductor 64 in housing 58 is given by Equation (7) above.

For purposes of explanation, active unit 50 is connected to inner conductor 54 at input terminal 51, active unit 52 is connected to inner conductor 56 at input terminal 53, and active unit 64 is connected to inner conductor 62 at input terminal 63.

Experimental results using the power combiner of the present invention for three active units are superior to any found in conventional power combiners for three active units. A power combiner of the present invention for three active units having the electrical circuit shown in FIG. 6 and the physical configuration of FIG. 5B has exhibited the electrical parameters shown in Table 4.

TABLE 4

| | |
|---|---|
| Frequency of operation | 144 mHz |
| Power output at terminal 60 | equal to the algebraic sum of the power from source 50, from source 52 and from source 62, irrespective of the impedances of the sources or the impedance connected to terminal 60 |
| Attenuation in dB from source 50 to terminal 60 | negligible |
| Attenuation in dB from source 52 to terminal 60 | negligible |
| Attenuation in dB from source 62 | negligible |
| Attenuation from source 50 to source 52 or to source 62 | in excess of 30 dB |
| Attenuation from source 52 to source 50 or to source 62 | in excess of 30 dB |
| Attenuation from source 62 to source 50 or source 52 | in excess of 30 dB |
| Attenuation in dB from source 50 to source 52 or 62, from source 52 to source 50 or 62, or from source 62 to source 50 or 52, at: | |
| 20% off center frequency | 20 dB |
| octave off center frequency | 12 dB |

Figure 5C:
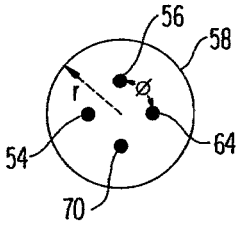
FIG. 5C is a cross-section of the preferred embodiment of the power combiner of the present invention for four input terminals and for one output terminal where the housing is a tube.

The cross-section of the preferred embodiment of the power combiner of the present invention for four active units when housing 5B is a tube is shown in FIG. 5C. The placement of inner conductor 54 in housing 58 is given by Equation (8) above, the placement of inner conductor 56 is given by Equation (9), the placement of inner conductor 64 is given by Equation (10) above, and the placement of an inner conductor 70 is given by Equation (11) above.

It should be noted that there appears to be no practical limit to the number of different active units that can be accommodated by the power combiner of the present invention. When there are n numbers of active units to be accommodated, n number λ/4 inner conductors must be provided in housing 58.

What is claimed is:

1. A power splitter for dividing radio frequency power applied to an input terminal equally among n output terminals, where n≧2 and is an integer, comprising:

(a) housing means being physically equal to λ/4 at the center frequency f of said power splitter for providing a λ/4 electromagnetically shielded volume having first and second openings;

(b) n separate inner conductors, each said inner conductor having a physical length equal to λ/4 at the center frequency f and having first and second ends;

(c) means for mounting each said inner conductor in said electromagnetically shielded volume whereby said inner conductors are electrically insulated from each other and from said housing means and said first end of each said inner conductor is at said first opening and said second end of each said inner conductor is at said second opening;

(d) said input terminal defined by electrically connecting together each said first end at said first opening and by electrically insulating said first ends from said housing; and (e) (n−1) separate electromagnetically shielded λ electrical lines (tuned for the center frequency f), each said λ line having a center conductor and a shield conductor, said shield conductor of each said λ line being electrically connected to said housing means, the center conductor of each said λ line being disposed between and electrically connecting together a separate pair of said second ends of said inner conductors so as to form an electrical ring with one such λ line missing between one of said pairs, whereby each of said second ends is an output terminal.

2. A power splitter as claimed in claim 1 wherein said housing means is a tube having an inner radius r.

3. A power splitter as claimed in claim 1 wherein said housing means is an electrically conductive tube and said inner conductors are arranged in said volume so that said inner conductors are approximately the same distance from each other as they are from said housing.

4. A power splitter as claimed in claim 1 wherein n=2, said housing is a tube having an inner radius r and a longitudinal axis, and said two separate inner conductors are arranged in said volume so that they are parallel said longitudinal axis and are always approximately the same distance from each other as they are from said inner surface of said tube.

5. A power splitter as claimed in claim 1 wherein n=3, said housing is a tube having an inner radius r and a longitudinal axis, and said three separate inner conductors are arranged in said volume so that they are parallel said longitudinal axis and are always approximately the same distance from each other as they are from said inner surface of said tube.

6. A power splitter as claimed in claim 1 wherein said housing is a tube having an inner radius r and a longitudinal axis, and said separate inner conductors are arranged in said volume so they are parallel said longitudinal axis and are all approximately the same distance from said inner surface of said tube.

7. A power combiner for summing radio frequency power applied to n input terminals, where n≧2 and is an integer, to an output terminal, comprising:

(a) housing means being physically equal to λ/4 at the center frequency f of said power combiner for providing a λ/4 electromagnetically shielded volume having first and second openings;

(b) n separate inner conductors, each said inner conductor having a physical length equal to λ/4 at the center frequency f and having first and second ends;

(c) means for mounting each said inner conductor in said electromagnetically shielded volume whereby said inner conductors are electrically insulated from each other and from said housing means and said first end of each said inner conductor is at said first opening and said second end of each said inner conductor is at said second opening; and (d) said output terminal defined by electrically connecting together each said second end at said second opening and by electrically insulating said first ends from said housing, whereby each of said first ends is an output terminal.

8. A power combiner as claimed in claim 7 wherein said housing means is a tube having an inner radius r.

9. A power combiner as claimed in claim 7 wherein said housing means is an electrically conductive tube and said inner conductors are arranged in said volume so that said inner conductors are approximately the same distance from each other as they are from said housing.

10. A power combiner as claimed in claim 7 wherein n=2, said housing is a tube having an inner radius r and a longitudinal axis, and said two separate inner conductors are arranged in said volume so that they are parallel said longitudinal axis and are always approximately the same distance from each other as they are from said inner surface of said tube.

11. A power combiner as claimed in claim 7 wherein n=3, said housing is a tube having an inner radius r and a longitudinal axis, and said three separate inner conductors are arranged in said volume so that they are parallel said longitudinal axis and are always approximately the same distance from each other as they are from the inner surface of said tube.

12. A power combiner as claimed in claim 7 wherein said housing is a tube having an inner radius r and a longitudinal axis, and said separate inner conductors are arranged in said volume so they are parallel said longitudinal axis and are approximately the same distance from said inner surface of said tube.

* * * * *